US008119226B2

(12) United States Patent
Reineck et al.

(10) Patent No.: US 8,119,226 B2
(45) Date of Patent: Feb. 21, 2012

(54) COATED CUTTING TOOL

(75) Inventors: Ingrid Reineck, Segeltorp (SE); Marianne Collin, Älvsjö (SE); Torbjörn Selinder, Stockholm (SE)

(73) Assignee: Sandvik Intellectual Property AB, Sandviken (SE)

( * ) Notice: Subject to any disclaimer, the term of this patent is extended or adjusted under 35 U.S.C. 154(b) by 489 days.

(21) Appl. No.: 11/905,166

(22) Filed: Sep. 27, 2007

(65) Prior Publication Data

US 2008/0131219 A1 Jun. 5, 2008

(30) Foreign Application Priority Data

Oct. 18, 2006 (SE) ..... 0602192-7
Oct. 18, 2006 (SE) ..... 0602193-5

(51) Int. Cl.
*B32B 9/00* (2006.01)

(52) U.S. Cl. ..... 428/216; 51/307; 51/309; 428/336; 428/325; 428/697; 428/698; 428/699; 428/701; 428/702

(58) Field of Classification Search ..... 51/307, 51/309; 428/216, 336, 325, 697, 698, 699, 428/701, 702
See application file for complete search history.

(56) References Cited

U.S. PATENT DOCUMENTS 4,346,123 A 8/1982 Kaufmann
4,619,866 A 10/1986 Smith et al.
4,701,384 A 10/1987 Sarin et al.
4,702,970 A 10/1987 Sarin et al.
4,749,629 A * 6/1988 Sarin et al. ..... 428/701
5,147,731 A * 9/1992 Gilmore et al. ..... 428/697
5,789,071 A * 8/1998 Sproul et al. ..... 428/702
5,827,570 A * 10/1998 Russell ..... 427/255.34
6,103,357 A 8/2000 Selinder et al.
6,660,371 B1 12/2003 Westphal et al.
7,326,461 B2 * 2/2008 Sottke et al. ..... 428/336
7,597,951 B2 * 10/2009 Bjormander et al. ..... 428/216

(Continued)

FOREIGN PATENT DOCUMENTS

DE 27 36 982 A1 3/1979

(Continued)

OTHER PUBLICATIONS

Qadri et al "Structural stability of ZrO2-Al2O3 thin films deposirited by magnetron sputtering" J. Vac Sci. Tech A 7 (3) May/Jun. 1989 p. 1220-1224.*

(Continued)

*Primary Examiner* — Archene Turner
(74) *Attorney, Agent, or Firm* — Morgan, Lewis & Bockius LLP

(57) ABSTRACT

A cutting tool includes a substrate on which at least on the functioning parts of the surface thereof a thin, adherent, hard and wear resistant coating is applied, wherein the coating includes a laminated multilayer of alternating PVD or PECVD metal oxide layers, $Me_1X+Me_2X+Me_1X+Me_2X\ldots$, where at least one of $Me_1X$ and $Me_2X$ is a metal oxide+metal oxide nano-composite layer composed of two components with different composition and different structure which components include a single phase oxide of one metal element or a solid solution of two or more metal oxides, wherein the layers $Me_1X$ and $Me_2X$ are different in composition or structure and have individual layer thicknesses larger than about 0.4 nm but smaller than about 50 nm and where said laminated multilayer layer has a total thickness of between about 0.2 and about 20 μm.

15 Claims, 1 Drawing Sheet

U.S. PATENT DOCUMENTS

| | | | | |
|---|---|---|---|---|
| 2005/0260432 | A1 | 11/2005 | Sottke et al. | |
| 2006/0257691 | A1 * | 11/2006 | Trinh et al. | 428/698 |
| 2010/0183884 | A1 | 7/2010 | Schier | |

FOREIGN PATENT DOCUMENTS

| | | | | |
|---|---|---|---|---|
| EP | 0 709 483 | | | 4/2002 |
| EP | 1717347 | A2 | | 11/2006 |
| JP | 61-201778 | | * | 9/1986 |
| JP | 61-270374 | | * | 11/1986 |
| JP | 63-192870 | A | | 8/1988 |
| SE | 0500648 | | | 10/2006 |
| SE | 529 143 | | | 5/2007 |
| SE | 529 144 | | | 5/2007 |
| WO | WO 99/58738 | | | 11/1999 |
| WO | 2004/029321 | A2 | | 4/2004 |
| WO | WO 2004/033751 | A1 | | 4/2004 |
| WO | WO-2006029747 | A2 | | 3/2006 |

OTHER PUBLICATIONS

Andritschky et al "Thermal stability of zirconia/alumina thin coatings produced by magnetron sputtering" Surf. and Coat. Tech 94-95 (1997) p. 144-148.*

Teixeira et al "Deposition of composite and nanolaminate ceramic coatings by sputtering" Vacuum (2002) p. 477-483.*

Portinha et al "Mechanical properties of ZrO2-Al2O3 nanostructured PVD coatings evaluated by nanoindentation" Rev. Adv. Mat. Sci. 5 (2003) p. 311-318.*

Henryk Tomaszewski et al., *Influence of Oxygen Content in a Sintering Atmosphere on the Phase Composition and Mechanical Properties of $Al_2O_3$-10wt% $ZrO_2$ Ceramics,* Journal of Materials Science Letters, vol. 7 (1988), pp. 778-780.

Anthony G. Evans, *Perspective on the Development of High-Toughness Ceramics,* J. Am. Ceram. Soc., vol. 73 (1990), pp. 187-206.

S. Ben Amor et al., *Characterization of Zirconia Films Deposited by R.F. Magnetron Sputtering,* Materials Science and Engineering, vol. B57 (1998), pp. 28-39.

Richard H. J. Hannink et al., *Transformation Toughening in Zirconia-Containing Ceramics,* J. Am. Ceram. Soc., vol. 83 (2000), pp. 461-487.

Joshua D. Kuntz et al., *Nanocrystalline-Matrix Ceramic Composites for Improved Fracture Toughness,* MRS Bulletin, Jan. 2004, pp. 22-27.

European Search Report dated May 29, 2009 issued in EP Application No. 07117451.0.

* cited by examiner

COATED CUTTING TOOL

CROSS-REFERENCE TO RELATED APPLICATIONS

This application claims priority under 35 U.S.C. §119 and/or §365 to Swedish Application No. 0602192-7, filed Oct. 18, 2006, and to Swedish Application No. 0602193-5, filed Oct. 18, 2006, the entire contents of each of these applications are incorporated herein by reference.

BACKGROUND OF THE INVENTION

The present invention relates to a coated cutting tool for metal machining having a substrate of a hard alloy and, on the surface of said substrate, a hard and wear resistant refractory coating deposited by Physical Vapor Deposition (PVD) or Plasma Enhanced Chemical Vapor Deposition (PECVD).

The process of depositing thin ceramic coatings (of from about 1 to about 20 μm) of materials like alumina, titanium carbides and/or nitrides onto, e.g., a cemented carbide cutting tool is a well established technology and the tool life of the coated cutting tool, when used in metal machining, is considerably prolonged. The prolonged service life of the tool may under certain conditions extend up to several hundred percent greater than that of an uncoated cutting tool. These ceramic coatings generally comprise either a single layer or a combination of layers. Modern commercial cutting tools are characterized by a plurality of layer combinations with double or multilayer structures. The total coating thickness varies between from about 1 and to about 20 μm and the thickness of the individual sub-layers varies between a few micrometers down to some hundredths of a micrometer.

The established technologies for depositing such layers are CVD and PVD (see, e.g., U.S. Pat. No. 4,619,866 and U.S. Pat. No. 4,346,123). PVD coated commercial cutting tools of cemented carbides or high speed steels usually have a single layer of TiN, Ti(C,N) or (Ti,Al)N, homogeneous in composition, or multilayer coatings of said phases, each layer being a one phase material.

There exist several PVD techniques capable of producing thin, refractory coatings on cutting tools. The most established methods are ion plating, magnetron sputtering, arc discharge evaporation and IBAD (Ion Beam Assisted Deposition) as well as hybrid processes of the mentioned methods. Each method has its own merits and the intrinsic properties of the produced layers such as microstructure and grain size, hardness, state of stress, cohesion and adhesion to the underlying substrate may vary depending on the particular PVD method chosen. An improvement in the wear resistance or the edge integrity of a PVD coated cutting tool being used in a specific machining operation can thus be accomplished by optimizing one or several of the above mentioned properties.

Particle strengthened ceramics are well known as construction materials in the bulk form, however not as nano-composites until recently. Alumina bulk ceramics with different nano-dispersed particles are disclosed in J. F. Kuntz et al, MRS Bulletin January 2004, pp 22-27. Zirconia and titania toughened alumina CVD layers are disclosed in for example U.S. Pat. No. 6,660,371, U.S. Pat. No. 4,702,907 and U.S. Pat. No. 4,701,384. In these latter disclosures, the layers are deposited by CVD technique and hence the $ZrO_2$ phase formed is the thermodynamically stable phase, namely the monoclinic phase. Furthermore, the CVD deposited layers are in general under tensile stress or low level compressive stress, whereas PVD or PECVD layers are typically under high level compressive stress due to the inherent nature of these deposition processes. In US 2005/0260432 blasting of alumina+zirconia CVD layers is described to give a compressive stress level. Blasting processes are known to introduce compressive stresses at moderate levels.

Metastable phases of zirconia, such as the tetragonal or cubic phases, have been shown to further enhance bulk ceramics through a mechanism known as transformation toughening (Hannink et al, J. Am. Ceram. Soc 83 (3) 461-87; Evans, Am. Ceram. Soc. 73 (2) 187-206 (1990)). Such metastable phases have been shown to be promoted by adding stabilizing elements such as Y or Ce or by the presence of an oxygen deficient environment, such as vacuum (Tomaszewski et al, J. Mater. Sci. Lett 7 (1988) 778-80), which is typically required for PVD applications. Variation of PVD process parameters has been shown to cause variations in the oxygen stoichiometry and the formation of metastable phases in zirconia, particularly the cubic zirconia phase (Ben Amor et al, Mater. Sci. Eng. B57 (1998) 28).

Multilayered PVD layers of metal nitrides or carbides for cutting applications are described in EP 0709483 where a symmetric multilayer structure of metal nitrides and carbides is revealed and U.S. Pat. No. 6,103,357 which describes an aperiodic laminated multilayer of metal nitrides and carbides.

Swedish Patent Nos. SE 529 144 C2 and SE 529 143 C2 disclose a cutting tool insert for metal machining on which at least on the functioning parts of the surface thereof a thin, adherent, hard and wear resistant coating is applied. The coating comprises a metal oxide+metal oxide nano-composite layer consisting of two components with a grain size of 1-100 nm.

OBJECTS AND SUMMARY OF THE INVENTION

It is an object of the present invention to provide a PVD or PECVD coated cutting tool with improved wear properties in combination with improved resistance to thermally initiated failure.

In accordance with the present invention there is provided a cutting tool comprising a substrate of cemented carbide, cermet, ceramics, cubic boron nitride or high speed steel on which at least on the functioning parts of the surface thereof a thin, adherent, hard and wear resistant coating is applied wherein said coating comprises a laminated multilayer of alternating PVD or PECVD metal oxide layers, $Me_1X+Me_2X+Me_1X+Me_2X$ . . . , where the metal atoms $Me_1$ and $Me_2$ are one or more of Ti, Nb, V, Mo, Zr, Cr, Al, Hf, Ta, Y and Si, and at least one of $Me_1X$ and $Me_2X$ is a metal oxide+metal oxide nano-composite layer composed of two components, component A and component B, with different composition and different structure which components comprise a single phase oxide of one metal element or a solid solution of two or more metal oxides, wherein the layers $Me_1X$ and $Me_2X$ are different in composition or structure or both these properties and have individual layer thicknesses larger than about 0.4 nm but smaller than about 50 nm and where said laminated multilayer has a total thickness of between about 0.2 and about 20 μm.

DETAILED DESCRIPTION OF THE PREFERRED EMBODIMENTS

Figure 1:
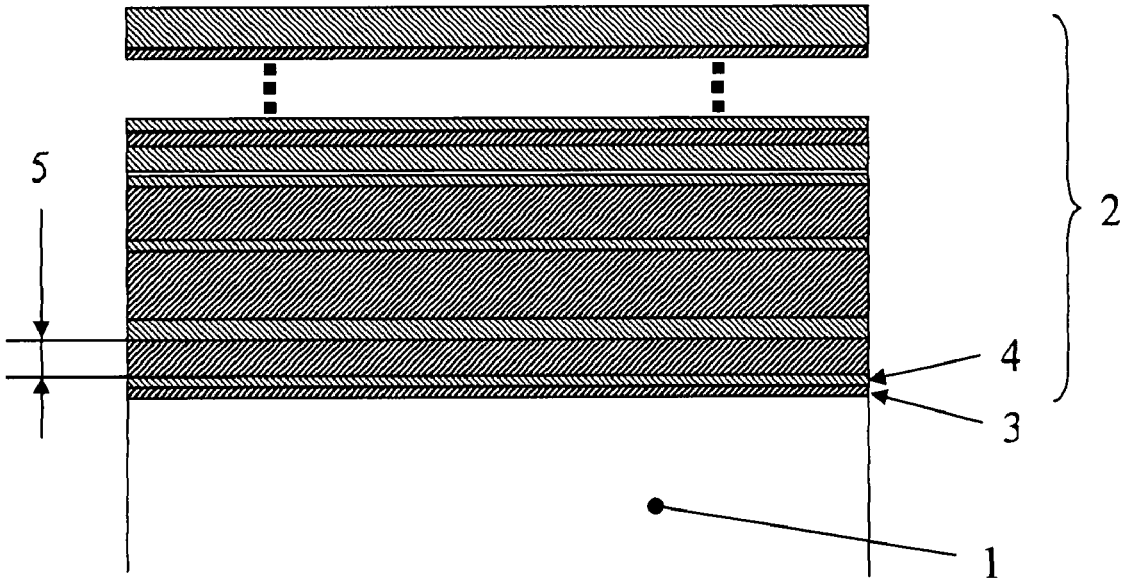
FIG. 1 is a schematic representation of a cross section taken through a coated cutting tool of the present invention showing a substrate (1) coated with an aperiodic, laminated multilayer (2) with individual metal oxide+metal oxide nano-composite layers $Me_1X$ (3), $Me_2X$ (4) each having an individual layer thickness (5). The sequence of the individual layer thicknesses is essentially aperiodic throughout the entire multilayer.

According to the present invention, there is provided a cutting tool for metal machining such as turning, milling and drilling comprising a substrate of a hard alloy of cemented carbide, cermet, ceramics, cubic boron nitride or high speed steel, preferably cemented carbide or cermet, onto which a wear resistant coating comprising a laminated multilayer has been deposited. The shape of the cutting tool includes indexable inserts as well as shank type tools such as drills, end mills etc. The coating may in addition comprise, beneath the laminated multilayer, a first, inner single layer or multilayer of metal carbides, nitrides or carbonitrides where the metal atoms are one or more of Ti, Nb, V, Mo, Zr, Cr, Al, Hf, Ta, Y or Si with a thickness in the range of about 0.2 to about 20 μm according to prior art.

The coating is applied onto the entire substrate or at least the functioning surfaces thereof, e.g., the cutting edge, rake face, flank face and any other surfaces which participate in the metal cutting process.

The coating according to the invention is adherently bonded to the substrate and comprises a laminated multilayer of alternating PVD or PECVD metal oxide layers, $Me_1X$+$Me_2X$+$Me_1X$+$Me_2X$ . . . , where the metal atoms $Me_1$ and $Me_2$ are one or more of Ti, Nb, V, Mo, Zr, Cr, Al, Hf, Ta, Y and Si, preferably Hf. Ta, Cr, Zr and Al, most preferably Zr and Al, and where at least one of $Me_1X$ and $Me_2X$ is a nano-composite layer of a dispersed metal oxide component in a metal oxide matrix, hereinafter referred to as a metal oxide+metal oxide nano-composite. The layers $Me_1X$ and $Me_2X$ are different in composition or structure or both these properties. The sequence of the individual $Me_1X$ or $Me_2X$ layer thicknesses is preferably aperiodic throughout the entire multilayer. By aperiodic is understood that the thickness of a particular individual layer in the laminated multilayer does not depend on the thickness of an individual layer immediately beneath nor does it bear any relation to an individual layer above the particular individual layer. Hence, the laminated multilayer does not have any repeat period in the sequence of individual coating thicknesses. Furthermore, the individual layer thickness is larger than about 0.4 nm but smaller than about 50 nm, preferably larger than 1 nm and smaller than about 30 nm, most preferably larger than about 5 nm and smaller than about 20 nm. The laminated multilayer has a total thickness of between about 0.2 and about 20 μm, preferably about 0.5 and about 5 μm.

One individual metal oxide+metal oxide nano-composite layer is composed of two components with different composition and different structure. Each component is a single phase oxide of one metal element or a solid solution of two or more metal oxides. The microstructure of the material is characterized by nano-sized grains or columns of a component A with an average grain or column size of from about 1 to about 100 nm, preferably from about 1 to about 70 nm, most preferably from about 1 to about 20 nm, surrounded by a component B. The mean linear intercept of component B is from about 0.5 to about 200 nm, preferably from about 0.5 to about 50 nm, most preferably from about 0.5 to about 20 nm.

The metal oxide+metal oxide nano-composite layer is understoichiometric in oxygen content with an oxygen:metal atomic ratio which is from about 85 to about 99%, preferably from about 90 to about 97%, of stoichiometric oxygen:metal atomic ratio. The volume contents of components A and B are from about 40 to about 95% and from about 5 to about 60% respectively.

In one exemplary embodiment of the invention, $Me_1X$ is a metal oxide+metal oxide nano-composite layer containing grains or columns of component A, preferably in the form of tetragonal or cubic zirconia, and a surrounding component B, preferably in the form of amorphous or crystalline alumina being one or both of alpha (α) and gamma (γ) phase, and $Me_2X$ is a $Al_2O_3$ layer, preferably being one or both of alpha (α) and gamma (γ) phase.

In another exemplary embodiment of the invention, $Me_1X$ is a metal oxide+metal oxide nano-composite layer containing grains or columns of component A in the form of an oxide of hafnium and a surrounding component B in the form of amorphous or crystalline alumina being one or both of alpha (α) and gamma (γ) phase, and $Me_2X$ is a $Al_2O_3$ layer, preferably being one or both of alpha (α) and gamma (γ) phase.

In another exemplary embodiment of the invention, $Me_1X$ is a metal oxide+metal oxide nano-composite layer containing grains or columns of component A and a surrounding component B, and $Me_2X$ is a metal oxide+metal oxide nano-composite layer containing grains or columns of component A and a surrounding component B, wherein the metal atom(s) of component A of $Me_1X$ is different from the metal atom(s) of component A of $Me_2X$ and/or the metal atom(s) of component B of $Me_1X$ is different from the metal atom(s) of component B of $Me_2X$.

In yet another exemplary embodiment of the invention, $Me_1X$ is a metal oxide+metal oxide nano-composite layer containing grains or columns of component A in the form of tetragonal or cubic zirconia and a surrounding component B in the form of amorphous or crystalline alumina, and $Me_2X$ is a metal oxide+metal oxide nano-composite layer containing grains or columns of component A in the form of tetragonal or cubic zirconia and a surrounding component B in the form of amorphous or crystalline alumina, wherein the volume content of components A in $Me_1X$ is >the volume content of components A in $Me_2X$, preferably the volume content of components A in $Me_1X$ is at least about 2.5% more than the volume content of components A in $Me_2X$ in absolute units, most preferably the volume content of components A in $Me_1X$ is at least about 5% more than the volume content of components A in $Me_2X$ in absolute units.

The laminated multilayer also possesses a residual stress as a result of the method of production, the stress being compressive in the range of about 200 to about 5000 MPa, preferably about 1000 to about 3000 MPa.

The coating may in addition comprise, on top of the laminated multilayer, an outer single layer or multilayer of metal carbides, nitrides or carbonitrides where the metal atoms are one or more of Ti, Nb, V, Mo, Zr, Cr, Al, Hf, Ta, Y and Si. The thickness of this layer is from about 0.2 to about 5 μm.

The layer according to the present invention is made by a PVD technique, a PECVD technique or a hybrid of such techniques. Examples of such techniques are RF (Radio Frequency) magnetron sputtering, DC magnetron sputtering and pulsed dual magnetron sputtering (DMS). The layer is formed at a substrate temperature of from about 200 to about 850° C.

When the type of PVD process permits, a metal oxide+metal oxide nano-composite layer is deposited using a composite oxide target material. A reactive process using metallic targets in an ambient reactive gas is an alternative process route. For the case of production of the metal oxide layers by a magnetron sputtering method, two or more single metal targets may be used where the metal oxide+metal oxide nano-composite composition is steered by switching on and off of separate targets. In a preferred method a target is a compound with a composition that reflects the desired layer composition. For the case of radio frequency (RF) sputtering, the composition is controlled by applying independently controlled power levels to the separate targets.

The aperiodic layer structure may be formed through the multiple rotation of substrates in a large scale PVD or PECVD process.

The invention is additionally illustrated in connection with the following examples, which are to be considered as illustrative of the present invention. It should be understood, however, that the invention is not limited to the specific details of the examples.

Example 1

An aperiodic laminated multilayer consisting of alternating metal oxide+metal oxide nano-composite $Al_2O_3$+$ZrO_2$ layers and $Al_2O_3$ layers, was deposited on a substrate using an RF sputtering PVD method.

The nano-composite layers were deposited with high purity oxide targets applying different process conditions in terms of temperature and zirconia to alumina ratio. The content of the two oxides in the formed nano-composite layer was controlled by applying one power level on the zirconia target and a separate power level on the alumina target. Alumina was added to the zirconia flux with the aim to form a composite material having metastable $ZrO_2$ phases. The target power level for this case was 80 W on each oxide target. The sputter rates were adjusted to obtain two times higher at-% of zirconium compared to aluminium. The oxygen:metal atomic ratio was 94% of stoichiometric oxygen:metal atomic ratio.

The $Al_2O_3$ layers were deposited using alumina targets in an argon atmosphere.

The resulting layers were analyzed by XRD and TEM. The XRD analysis showed no traces of crystalline $Al_2O_3$ in the nano-composite layer, while the $Al_2O_3$ layers consisted mainly of gamma $Al_2O_3$.

The TEM investigation showed that the deposited coating consisted of a laminated multilayer of alternating metal oxide+metal oxide nano-composite layers, comprising grains with an average grain size of 4 nm (component A) surrounded by an amorphous phase with a linear intercept of 2 nm (component B), and gamma $Al_2O_3$ layers. The grains of the nano-composite layers were cubic $ZrO_2$ while the surrounding phase had high aluminium content. The individual layer thicknesses ranged from 6 to 20 nm and the total multilayer thickness was about 1 μm.

The relative volume content of the two components A and B was approximately 70% and 30%, respectively, as determined from ERDA analysis and EDS line scans from TEM images.

Example 2

A laminated multilayer coating consisting of alternating metal oxide+metal oxide nano-composite layers of $Al_2O_3$+$ZrO_2$ and gamma $Al_2O_3$ layers was deposited on a substrate using a reactive RF sputtering PVD method with high purity Al and Zr targets in an argon and oxygen atmosphere. The content of the two oxides in the formed layer was controlled by applying one power level on the Zr target and a separate power level on the Al target. The sputter rates were adjusted with the aim to form a composite material with 1-2 times higher at-% of zirconium. The $Al_2O_3$ layers were deposited using aluminium targets in an argon+oxygen atmosphere.

The XRD results showed presence of metastable $ZrO_2$ phases in the nano-composite layers. The TEM investigation showed that the deposited coating consisted of a laminated multilayer of alternating metal oxide+metal oxide nano-composite layers, comprising grains with an average grain size of 6 nm (component A) surrounded by an amorphous phase with a linear intercept of 3 nm (component B), and gamma $Al_2O_3$ layers. The grains of the nano-composite layers had high zirconium content while the surrounding phase had high aluminium content. The individual layer thicknesses ranged from 10 to 20 nm and the total multilayer thickness was about 3 μm.

The relative volume content of the two components A and B was approximately 75% and 25%, respectively, as determined from ERDA analysis and EDS line scans from TEM images.

Example 3

A laminated multilayer coating consisting of two alternating metal oxide+metal oxide nano-composite layers of $Al_2O_3$+$ZrO_2$ was deposited on a substrate using a dual magnetron sputtering PVD method with high purity Al+Zr targets in an argon and oxygen atmosphere. The content of the two oxides in the formed respective nano-composite layers was controlled by the relative content of the two elements in the targets. The substrates were subjected to a threefold rotation by rotation of the whole substrate table, the separate holders for the pins where the substrates are mounted and the individual pins.

The XRD results showed presence of metastable $ZrO_2$ phases in the layers. The TEM investigation showed that the deposited coating consisted of a laminated multilayer of two alternating metal oxide+metal oxide nano-composite layers, comprising grains with an average grain size of 6 nm (component A). The grains of the layers had high zirconium content while the surrounding phase had high aluminium content. The individual layer thicknesses ranged from 10 to 20 nm and the total multilayer thickness was about 3 μm.

ERDA analysis and EDS line scans from TEM images revealed that the laminated multilayer consisted of alternating layers: a first layer type having a volume content of component A of about 70% and component B of about 30, and a second layer type having a volume content of component A of about 50% and component B of about 50%.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A cutting tool comprising a substrate of cemented carbide, cermet, ceramics, cubic boron nitride or high speed steel on which at least on the functioning parts of the surface thereof a thin, adherent, hard and wear resistant coating is applied wherein said coating comprises a laminated multilayer of alternating PVD or PECVD metal oxide layers, $Me_1X$+$Me_2X$+$Me_1X$+$Me_2X$ . . . , where the metal atoms $Me_1$ and $Me_2$ are one or more of Ti, Nb, V, Mo, Zr, Cr, Al, Hf, Ta, Y and Si, and at least one of $Me_1X$ and $Me_2X$ is a metal oxide+metal oxide nano-composite layer composed of two components, component A and component B, with different composition and different structure which components comprise a single phase oxide of one metal element or a solid solution of two or more metal oxides, wherein the layers $Me_1X$ and $Me_2X$ are different in composition or structure or both these properties and have individual layer thicknesses larger than about 0.4 nm but smaller than about 50 nm and where said laminated multilayer has a total thickness of between about 0.2 and about 20 μm, wherein a volume content of component A is from about 40% to about 95% and a volume content of component B is from about 5% to about 60%.

2. Cutting tool of claim 1 wherein said individual $Me_1X$ and $Me_2X$ layer thicknesses are larger than about 1 nm and smaller than about 30 nm.

3. Cutting tool of claim 1 wherein the coating in addition comprises a first, inner single layer or multilayer of metal carbides, nitrides or carbonitrides with a thickness between about 0.2 and about 20 μm where the metal atoms are chosen from one or more of Ti, Nb, V, Mo, Zr, Cr, Al, Hf, Ta, Y or Si.

4. Cutting tool of claim 1 wherein the coating additionally comprises, on top of the laminated multilayer, an outer single layer or multilayer coating of metal carbides, nitrides or carbonitrides with a thickness between about 0.2 and about 5 μm where the metal atoms are chosen from one or more of Ti, Nb, V, Mo, Zr, Cr, Al, Hf, Ta, Y or Si.

5. Cutting tool of claim 1 wherein said component A has an average grain size of from about 1 to about 100 nm.

6. Cutting tool of claim 1 wherein said component B has a mean linear intercept of from about 0.5 to about 200 nm.

7. Cutting tool of claim 1 wherein said component A contains tetragonal or cubic zirconia and said component B is amorphous or crystalline alumina, being one or both of the alpha (α) and the gamma (γ) phase.

8. Cutting tool of claim 1 wherein $Me_1X$ is a metal oxide+metal oxide nano-composite layer and $Me_2X$ is crystalline alumina layer of one or both of the alpha (α) and the gamma (γ) phase.

9. Cutting tool of claim 1 wherein said metal atoms $Me_1$ and $Me_2$ are one or more of Hf, Ta, Cr, Zr and Al.

10. Cutting tool of claim 9 wherein said metal atoms are one or more of Zr and Al.

11. Cutting tool of claim 5 wherein said component A has an average grain size of about 1 to about 70 nm.

12. Cutting tool of claim 11 wherein said component A has an average grain size of about 1 to about 20 nm.

13. Cutting tool of claim 6 wherein said component B has a mean linear intercept of from about 0.5 to about 50 nm.

14. Cutting tool of claim 6 wherein said component B has a mean linear intercept of from about 0.5 to about 20 nm.

15. Cutting tool of claim 1, wherein the metal oxide+metal oxide nano-composite layer is understoichiometric in oxygen with an oxygen:metal atomic ratio from about 85% to about 99%.

* * * * *